US007500337B2

(12) United States Patent
Yuyama et al.

(10) Patent No.: US 7,500,337 B2
(45) Date of Patent: Mar. 10, 2009

(54) MEDICINE PACKAGING DEVICE

(75) Inventors: Shoji Yuyama, Toyonaka (JP); Toru Tanaka, Toyonaka (JP); Toshihiro Amatsu, Minoo (JP); Satoshi Asada, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/551,128

(22) PCT Filed: Mar. 26, 2004

(86) PCT No.: PCT/JP2004/004250

§ 371 (c)(1),
(2), (4) Date: Sep. 29, 2005

(87) PCT Pub. No.: WO2004/089758

PCT Pub. Date: Oct. 21, 2004

(65) Prior Publication Data

US 2006/0254210 A1 Nov. 16, 2006

(30) Foreign Application Priority Data

Apr. 2, 2003 (JP) ..... 2003-099549
Sep. 26, 2003 (JP) ..... 2003-336456

(51) Int. Cl.
*B65B 61/26* (2006.01)

(52) U.S. Cl. ..... 53/131.2; 53/411

(58) Field of Classification Search ..... 53/131.2, 53/131.5, 131.4, 411, 128.1; 156/350, 351, 156/367, 384, 494

See application file for complete search history.

(56) References Cited

U.S. PATENT DOCUMENTS 3,191,356 A * 6/1965 Zelnick et al. ..... 53/555

(Continued)

FOREIGN PATENT DOCUMENTS

CA 928732 6/1973

(Continued)

OTHER PUBLICATIONS

Chinese Office Action, issued Dec. 7, 2007.

*Primary Examiner*—Paul R Durand
(74) *Attorney, Agent, or Firm*—Wenderoth, Lind & Ponack, L.L.P.

(57) ABSTRACT

A medicine packing apparatus in which a packing sheet (7) can be printed with predetermined information by a printing device (5). In the apparatus medicine can be fed into the packing sheet (7) by a medicine feeder (2, 3), and the packing sheet (7) can be sealed by a sealing device (8) to pack the medicine in a single package. The sealing device (8) is provided with conveyance portion (39) for conveying the packing sheet (7). In the middle of a conveyance path from the printing device (5) to the sealing device (8), there are provided a moving mechanism (12) which comes into contact with the packing sheet (7) and moves so that the tension of the packing sheet (7) is held at a constant value, and a position detector (33) which detects a moved position of the moving mechanism (12). After the packing sheet (7) is conveyed by the conveyance portion (39) and the position detector (33) detects a predetermined moved position, printing by the printing device (5) is started.

7 Claims, 10 Drawing Sheets

U.S. PATENT DOCUMENTS

| | | | | | |
|---|---|---|---|---|---|
| 3,556,510 | A | | 1/1971 | Treff | |
| 5,097,652 | A | * | 3/1992 | Inamura et al. | 53/493 |
| 5,371,521 | A | * | 12/1994 | Wehrmann | 347/171 |
| 5,458,729 | A | * | 10/1995 | Galchefski et al. | 156/566 |
| 5,468,080 | A | * | 11/1995 | Jones | 400/618 |
| 5,714,996 | A | * | 2/1998 | Hodai | 347/217 |
| 5,819,500 | A | | 10/1998 | Haraguchi et al. | |
| 5,823,692 | A | * | 10/1998 | Tolrud et al. | 400/582 |
| 6,067,103 | A | * | 5/2000 | Ewert et al. | 347/171 |
| 6,155,963 | A | * | 12/2000 | Simmons | 493/464 |
| 6,470,648 | B1 | * | 10/2002 | Baker | 53/411 |
| 6,543,201 | B2 | * | 4/2003 | Cronauer et al. | 53/131.5 |
| 6,742,317 | B2 | * | 6/2004 | Cronauer et al. | 53/411 |

FOREIGN PATENT DOCUMENTS

| | | |
|---|---|---|
| CN | 2470325 | 1/2002 |
| EP | 0 760 234 | 3/1997 |
| JP | 3-98835 | 4/1991 |
| JP | 6-144665 | 5/1994 |
| JP | 2579010 | 11/1996 |
| JP | 9-58603 | 3/1997 |
| JP | 10-95559 | 4/1998 |

* cited by examiner

MEDICINE PACKAGING DEVICE

BACKGROUND OF THE INVENTION

1. Technical Field

The present invention relates to a medicine packing apparatus.

2. Description of Related Art

Conventionally, as a medicine packing apparatus, there has been an apparatus which is provided with two printer heads for printing the medicine packing sheet with patient name, medicine name, usage and so on; between which a detection roller rotatable due to contact with the packing sheet and an encoder for detecting a feed quantity of the packing sheet based on the rotation quantity of the detection roller are provided so that the printer heads are operated based on the detection result of the encoder to print the packing sheet (for example, Japanese patent No. 2579010).

However, in the medicine packing apparatus, only the feed quantity of the packing sheet is detected. Therefore, there has been a disadvantage that if the packing sheet is slack between the printer heads and a heat-seal portion at the downstream side of the printer heads when starting the print, the dimension between the print position and the heat-seal position can not be held to be a predetermined value, thus preventing printing at a desired position.

SUMMARY OF THE INVENTION

It is an object of the present invention to provide a medicine packing apparatus capable of printing the packing sheet accurately at the desired position.

The present invention provides a medicine packing apparatus in which a packing sheet is printed with predetermined information by printing means, medicine is fed into the packing sheet in medicine feed means, and the packing sheet is sealed by seal means to pack the medicine by one package, wherein:

the seal means is provided with conveyance portion for conveying the packing sheet;

in the middle of a conveyance path from the print means to the seal means, there are provided moving means which comes into contact with the packing sheet and moves so that the tension of the packing sheet is held to be a constant value, and position detecting means which detects a moved position of the moving means;

whereby after the packing sheet is conveyed by the conveyance portion and the position detecting means detects a predetermined moved position, print by the print means is started.

In the above construction, a dimension between a moved position of the moving means, i.e. a contact position with the packing sheet and a print position by the print means can be made a predetermined value, thereby preventing a shift of the sealing position.

The moving means may comprise a roller which is rotatable and movable and urging means which urges the packing sheet with a constant force to eliminate any slack in the packing sheet.

It is preferable that the roller is a tension roller attached on a descending and ascending table which descends and ascends along a guide rail, the tension roller forcing up the packing sheet, and that the urging means is a spring for urging the descending and ascending table in an upward direction.

It is also preferable that the position detecting means detects a descending position of the descending and ascending table.

Further, the present invention provides a medicine packing apparatus in which a packing sheet is printed with predetermined information by printing means, medicine is fed into the packing sheet by medicine feed means, and the packing sheet is sealed by seal means to pack the medicine by one package, wherein:

the seal means is provided with conveyance portion for conveying the packing sheet;

in the middle of a conveyance path from the print means to the seal means, there is provided tension detecting means which detects a tension act on the packing sheet;

whereby after the packing sheet is conveyed by the conveyance portion and tension detecting means detects a predetermined tension of the packing sheet, print by the print means is started.

In the above construction, the print by the print means can be started in a condition where a constant tension acts on the packing sheet and no slack exists, thereby enabling formation of a seal at a constant position with respect to the print position.

According to the present invention, after the detected tension becomes a predetermined value, print by the printing means can be started, allowing the positional relationship between the conveying position and the print position to be accurately held at a constant value, so as to enable printing at the desired position.

BRIEF DESCRIPTION OF THE DRAWINGS

FIG. 10(*a*) is an enlarged view in the vicinity of a connection portion between a feed heat-seal portion and a vertical heat-seal portion of the embodiment of the present invention and FIG. 10(*b*) is an enlarged view in the vicinity of a connection portion between a feed heat-seal portion and a vertical heat-seal portion of a conventional heater roller.

DETAILED DESCRIPTION OF THE INVENTION

Hereinafter, embodiments according to the present invention will be described in accordance with the accompanying drawings.

Figure 1:
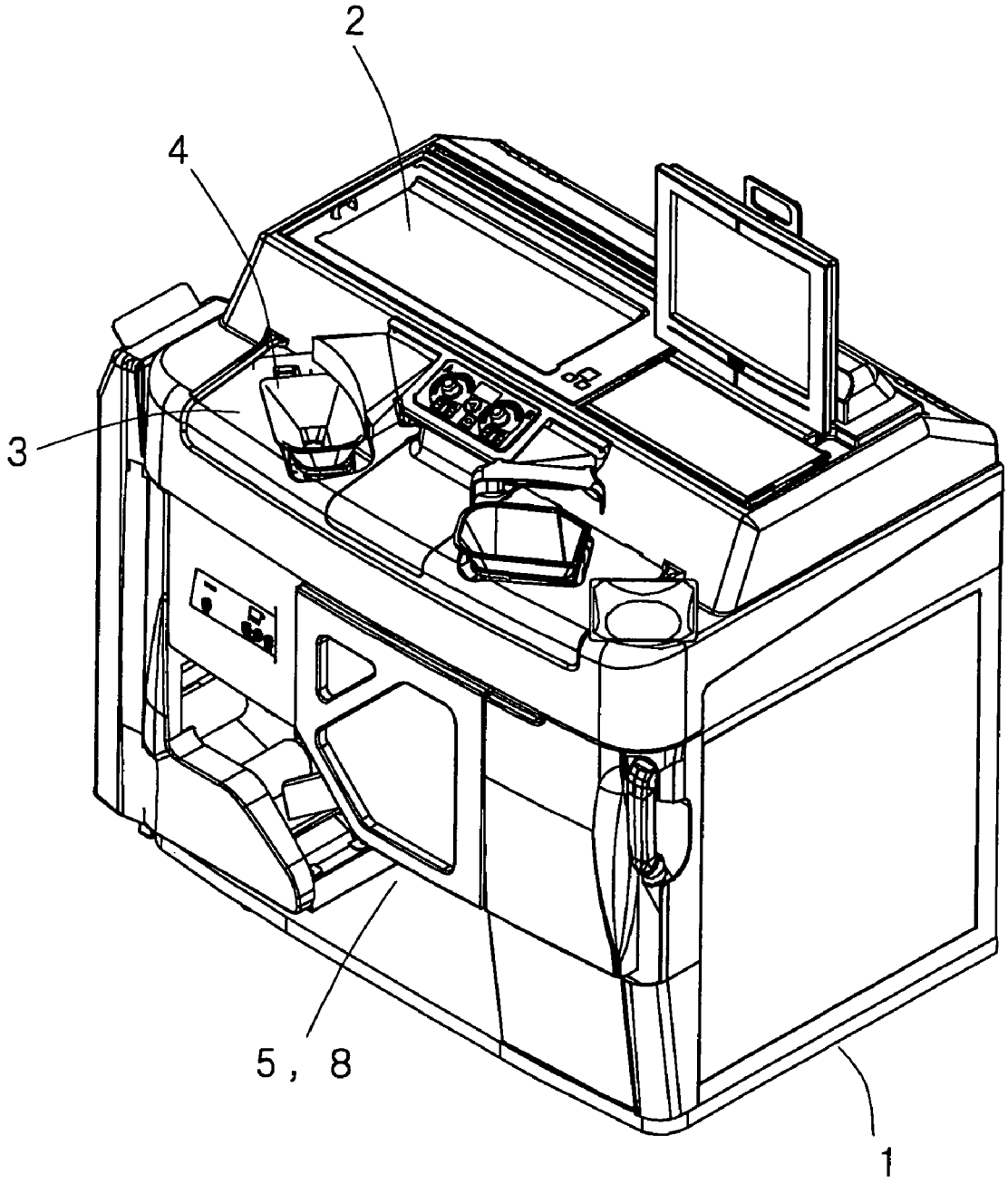
FIG. 1 is a perspective view of a medicine packing apparatus according to an embodiment of the present invention.

FIG. 1 shows a medicine packing apparatus according to the embodiment of the present invention. The medicine packing apparatus is provided with a tablet feed portion 2 as the medicine feed means of the present invention and a powder feed portion 3 on the upper side of an apparatus body 1 and provided with a print unit (print means) 5 and a packing unit 8 on the lower side thereof.

The tablet feed portion 2 is constructed so that when tablets to be packed into one package are previously manually put in each box formed like a lattice, a bottom plate of each box is sequentially opened to feed the tablets to the packing unit 8.

The powder feed portion 3 is constructed so that, when powder is poured through a hopper 3, the powder is fed in an outer annular groove of a distribution dish (not shown) and the powder to be packed into one package is scraped out by a powder scraping apparatus (not shown) to feed the powder to the packing unit 8.

Figure 2:
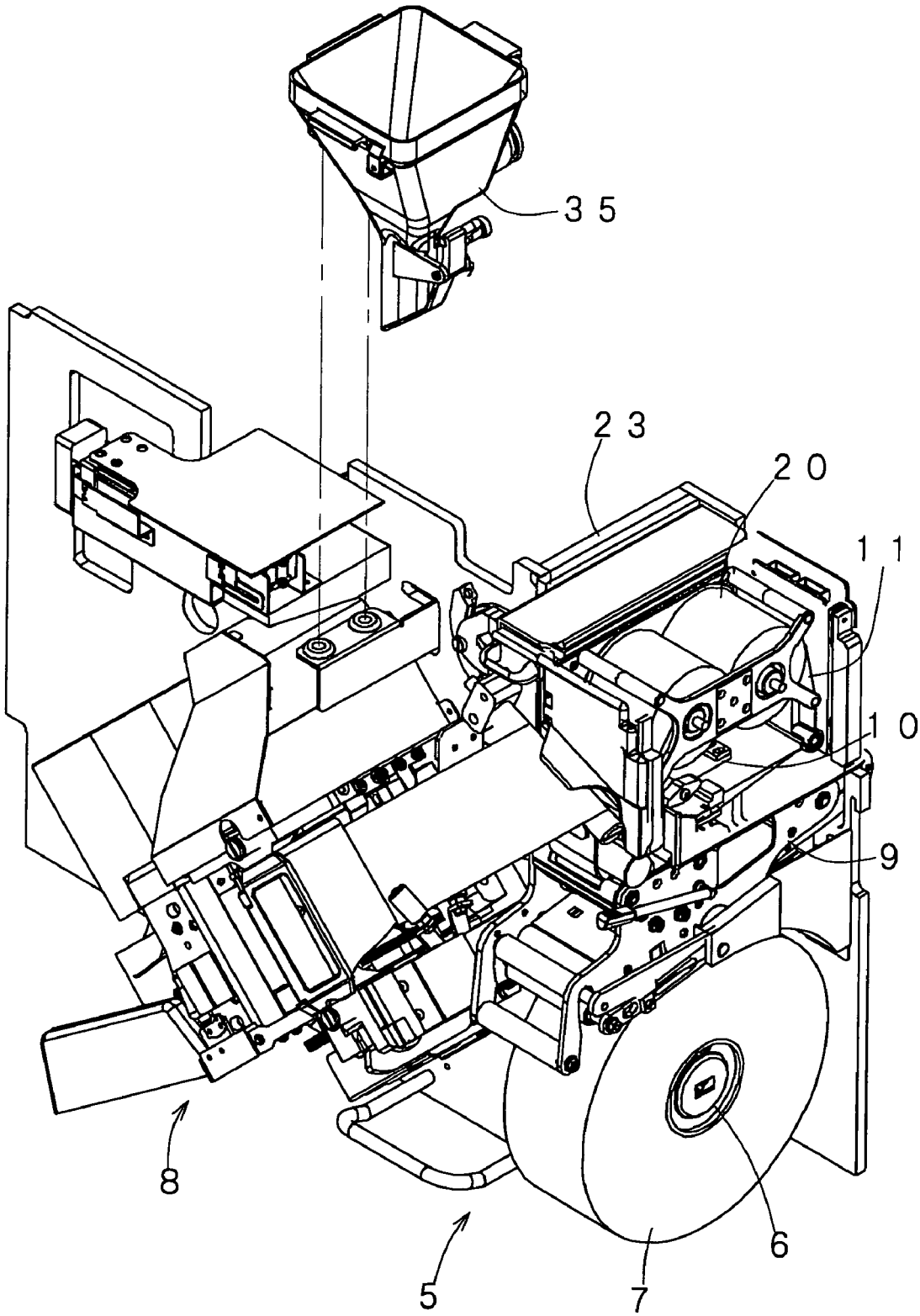
FIG. 2 is a perspective view showing a print unit and a packing unit of FIG. 1.
Figure 3:
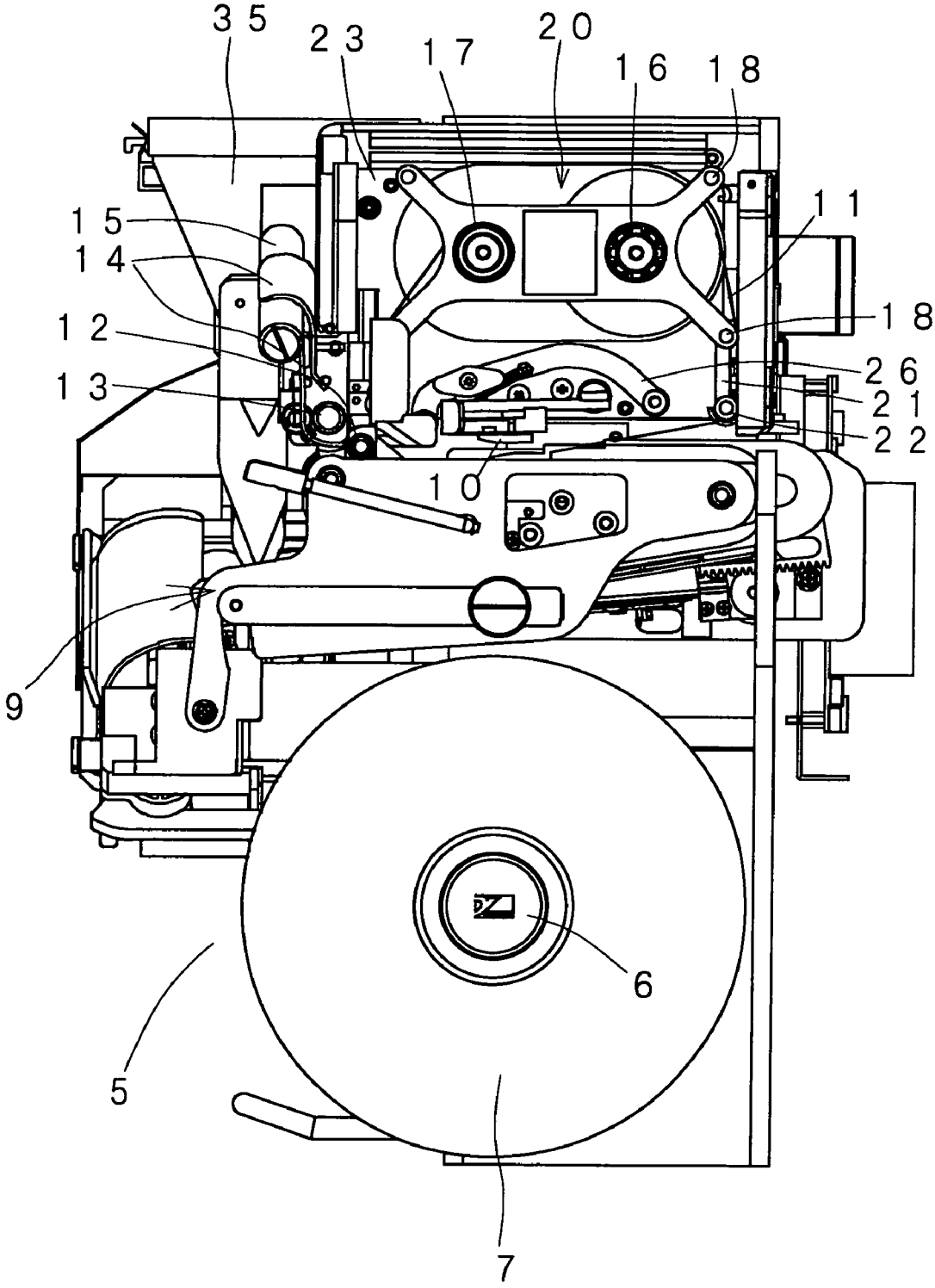
FIG. 3 is a front view of the print unit of FIG. 2.
Figure 4:
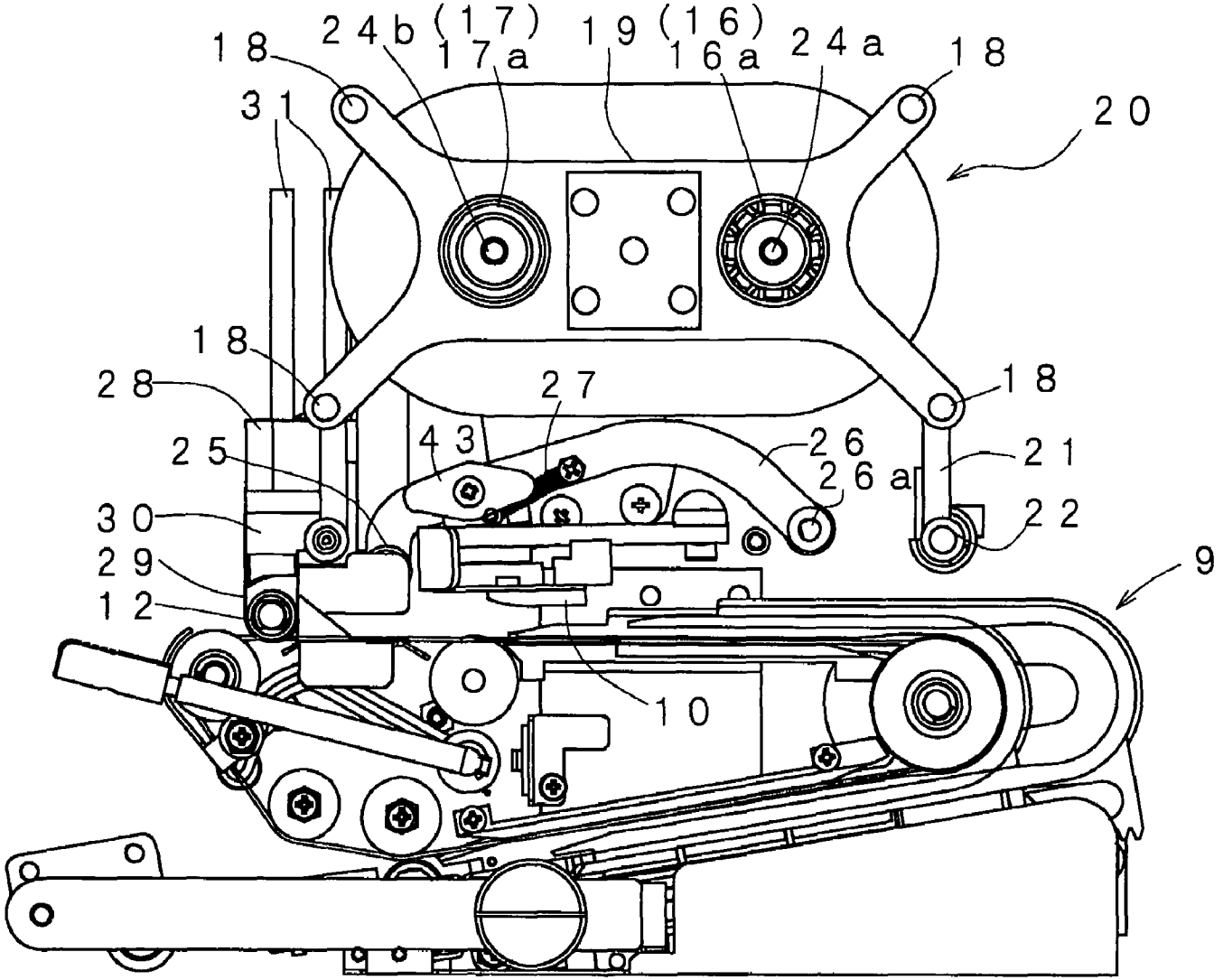
FIG. 4 is a partly enlarged front view of FIG. 3.

The print unit 5 is constructed so that, as shown in FIGS. 2 to 4, a packing sheet 7 wound on a roll 6 is rewound and printed with patient name, medicine name, usage and so on and then conveyed to the packing unit 8. The packing sheet 7 is turned to in horizontal direction by a guide portion 9 and then ink of an ink ribbon 11 is thermal transferred to the upper surface of the packing sheet 7 by means of a thermal transfer portion (printer head) 10. The printed packing sheet 7 passes through a tension roller 12 and is turned upward by means of a first roller 13. Then, the packing sheet 7 is guided by a guide piece 14 to move upward and then turned obliquely downward by means of a second roller 15 to advance toward the packaging unit 8. The ink ribbon 11, as shown in FIGS. 3 and 4, is wound on a first roll 16 and continuously rewound on a second roll 17. Each of the rolls 16, 17 is cylindrical and inner cylinders 16*a*, 17*a* are supported on holding plates 19 which are fixed on both ends of four guide shafts 18 disposed around the rolls to constitute an ink cartridge 20. An auxiliary roller 22 is rotatably attached to the end of an arm portion 21 extending from the lower guide shaft 18.

The ink cartridge 20 is attached on a side plate 23 by fitting the inner cylinders 16*a*, 17*a* of the rolls 16, 17 on shaft portions 24*a*, 24*b* protruding from the side plate 23 and then screwing nuts or so on the ends of shaft portions 24*a*, 24*b*. Driving a motor (ink ribbon conveying portion) (not shown) to rotate the shaft portion 24*b* allows the ink ribbon 11, which is wound on the first roll 16, to be rewound on the second roll 17. The ink ribbon 11 is positioned between the thermal transfer portion 10 and the guide portion 9 and the slack of the ink ribbon 11 is removed by an urged roller 25. The urged roller 26 is rotatably attached on the end of an arm member 26 rotatably provided around a support shaft 26*a*. The arm member 26 is urged in a clockwise direction in FIG. 4 by a spring 27, one end of which is engaged with an attachment piece 43 that is attached on the apparatus body 1.

Figure 5:
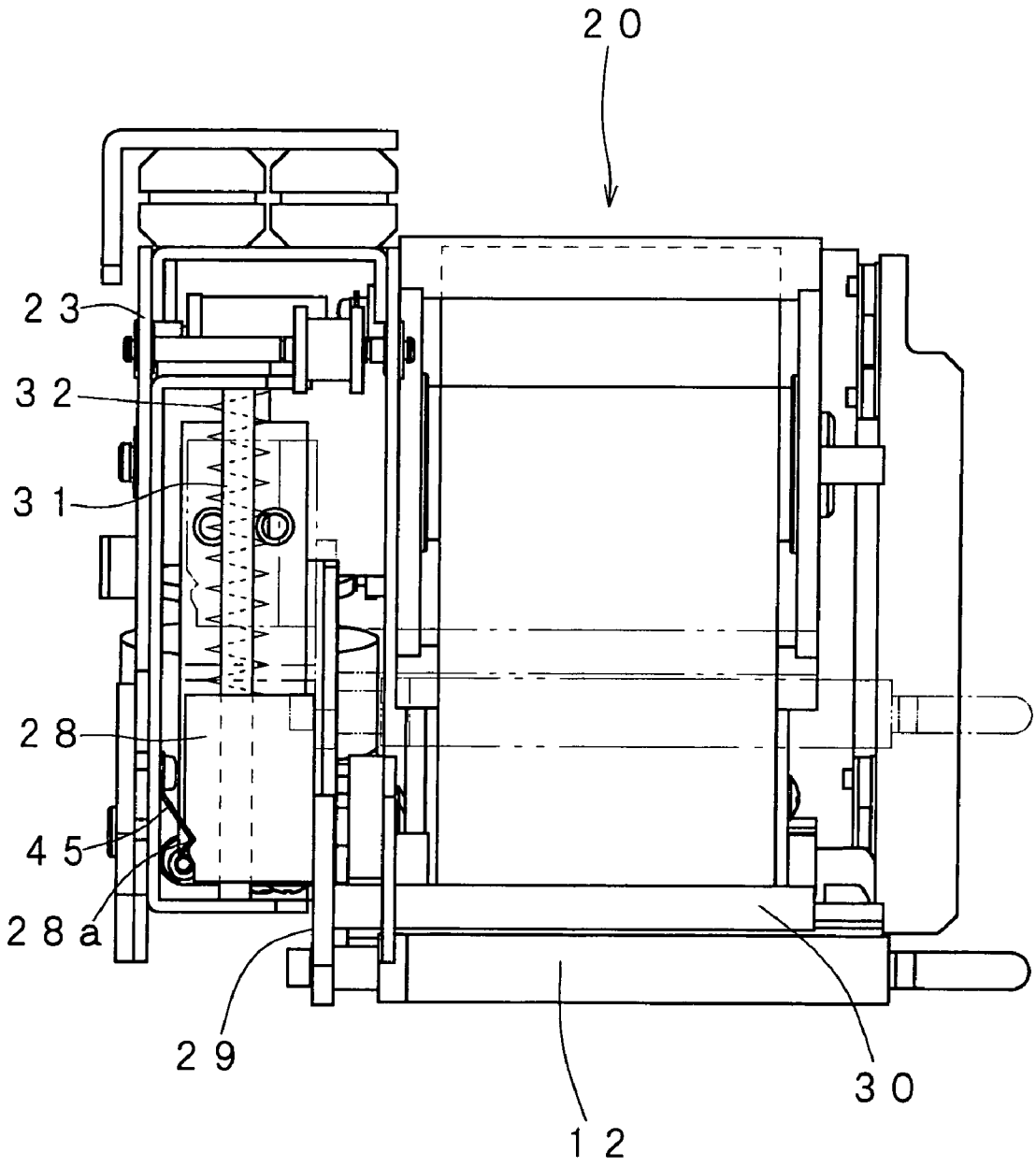
FIG. 5 is an enlarged left side view of FIG. 4.
Figure 6:
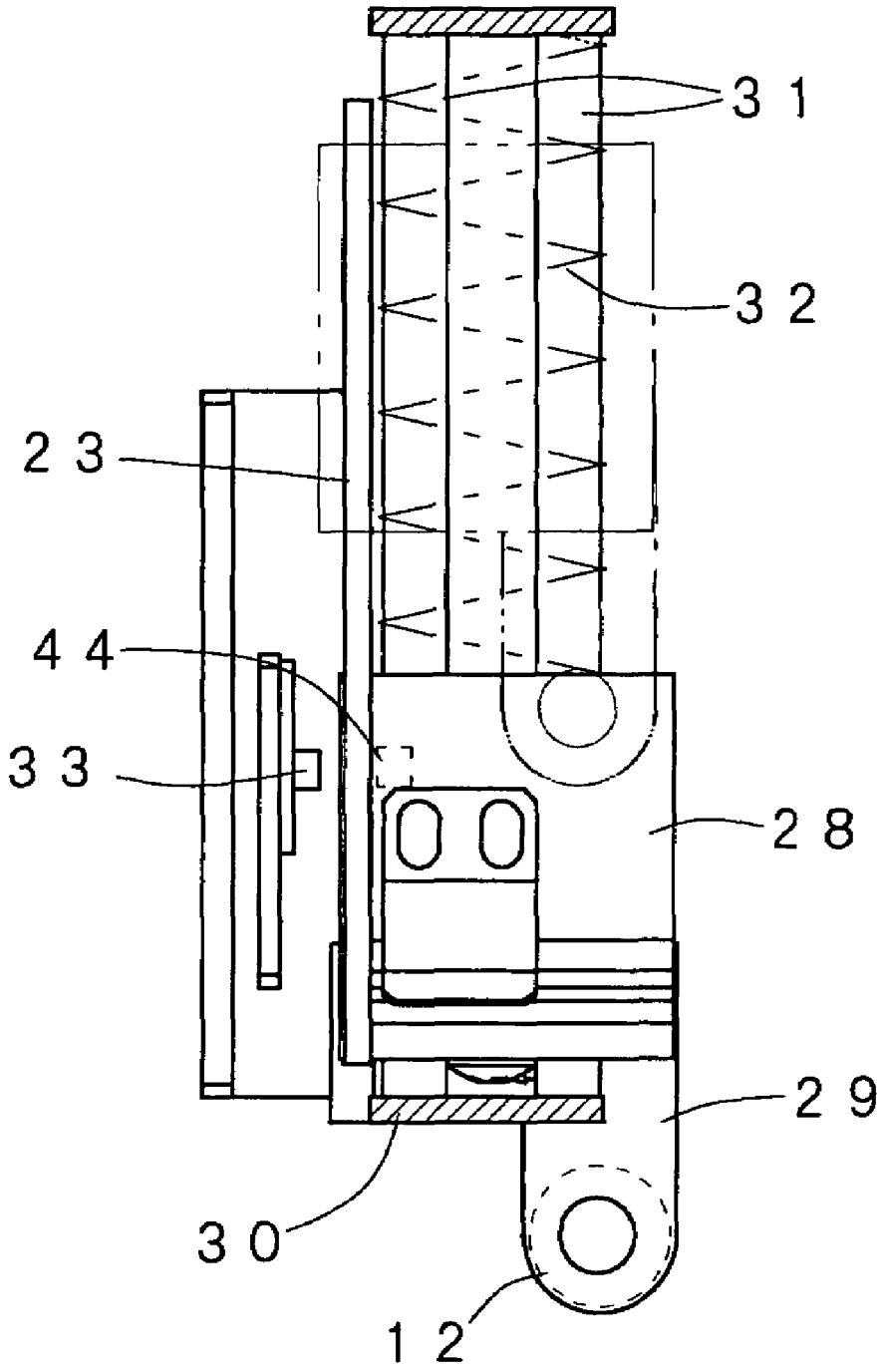
FIG. 6 is an enlarged view in the vicinity of a tension roller of FIG. 5.

The tension roller 12 (moving means), as shown in FIGS. 5 and 6, is attached on the support portion 29 extending from a descending and ascending table 28. The descending and ascending table 28 is provided with a cover 30 for forming a path, through which the packing sheet 7 passes, above the tension roller 12. The descending and ascending table 28 is provided so as to descend and ascend along guide rails 31 uprightly provided at a predetermined distance and the table is urged upward by a spring 32. A descending position of the descending and ascending table 28 is specified by detecting a magnet 44 built in the descending and ascending table 28 by means of a sensor 33 (position detecting means) disposed aside. In order to make it possible to easily insert the packing sheet 7, the descending and ascending table 28 is positioned at a lowest position by engaging an engagement recess portion 29*a* with a engagement piece 45 comprising a leaf spring attached on the side plate 23.

The packing unit 8 is constructed so that the packing sheet 7 printed by the print unit 5 is folded into two or previously has been folded into two. The packing sheet 7 is sealed in a longitudinal direction at predetermined intervals by means of a seal portion 34 that is a sealing means of the present invention to form a bag portion. The medicine fed from the tablet feed portion 2 or the powder feed portion 3 is introduced into the formed bag; and the remaining one side of the packing sheet 7 is sealed.

Figure 7:
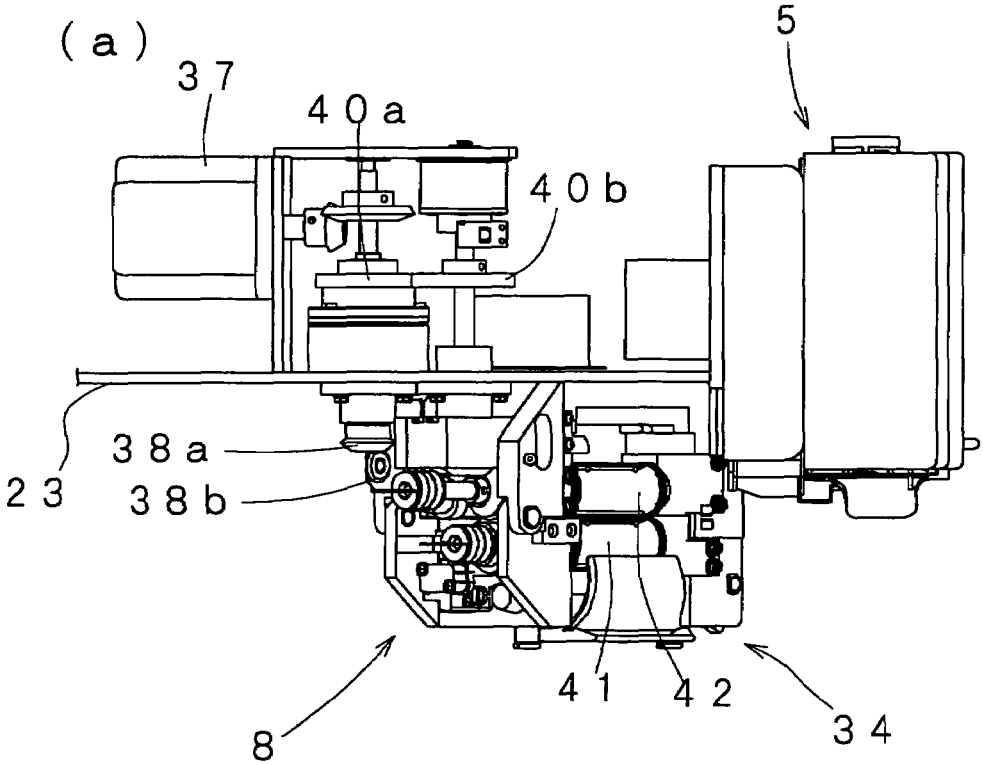
FIG. 7(*a*) is a plan view of the packing unit of FIG. 1 and FIG. 7(*b*) is a front view thereof.
Figure 7:
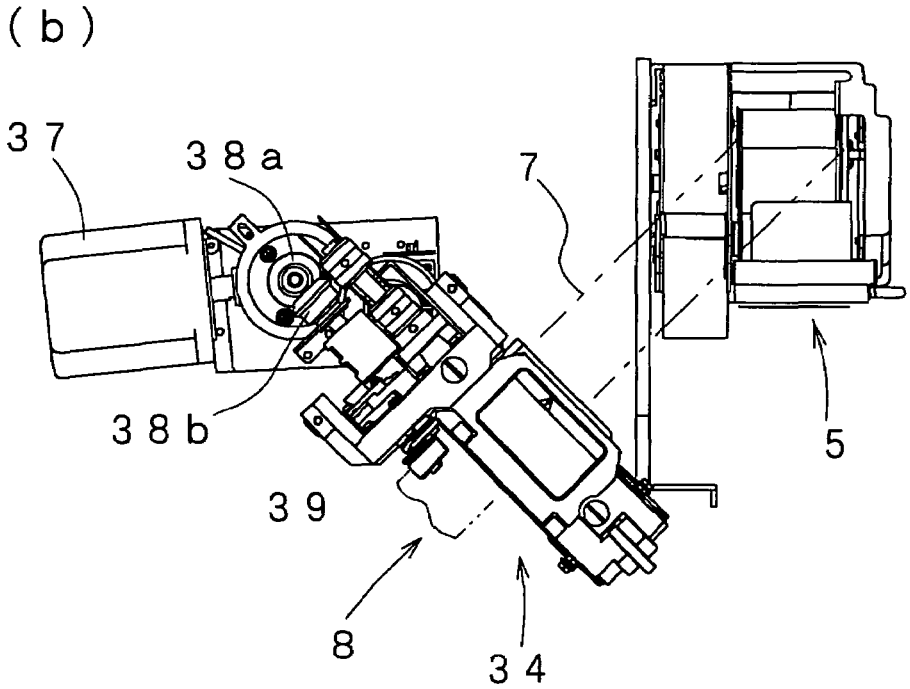

The seal portion 34 is attached in an oblique state corresponding to the packing sheet 7 that advances obliquely downward. In the seal portion 34, as shown in FIG. 7, a pair of feed rollers 39 is intermittently driven via a directly driven gear 38*a* and an intermittently driven gear 38*b* by means of a motor 37 provided on the rear surface side of the side plate 23 of the apparatus body 1. Thus, the packing sheet 7, sandwiched between the feed rollers 39, is intermittently conveyed.

Figure 9:
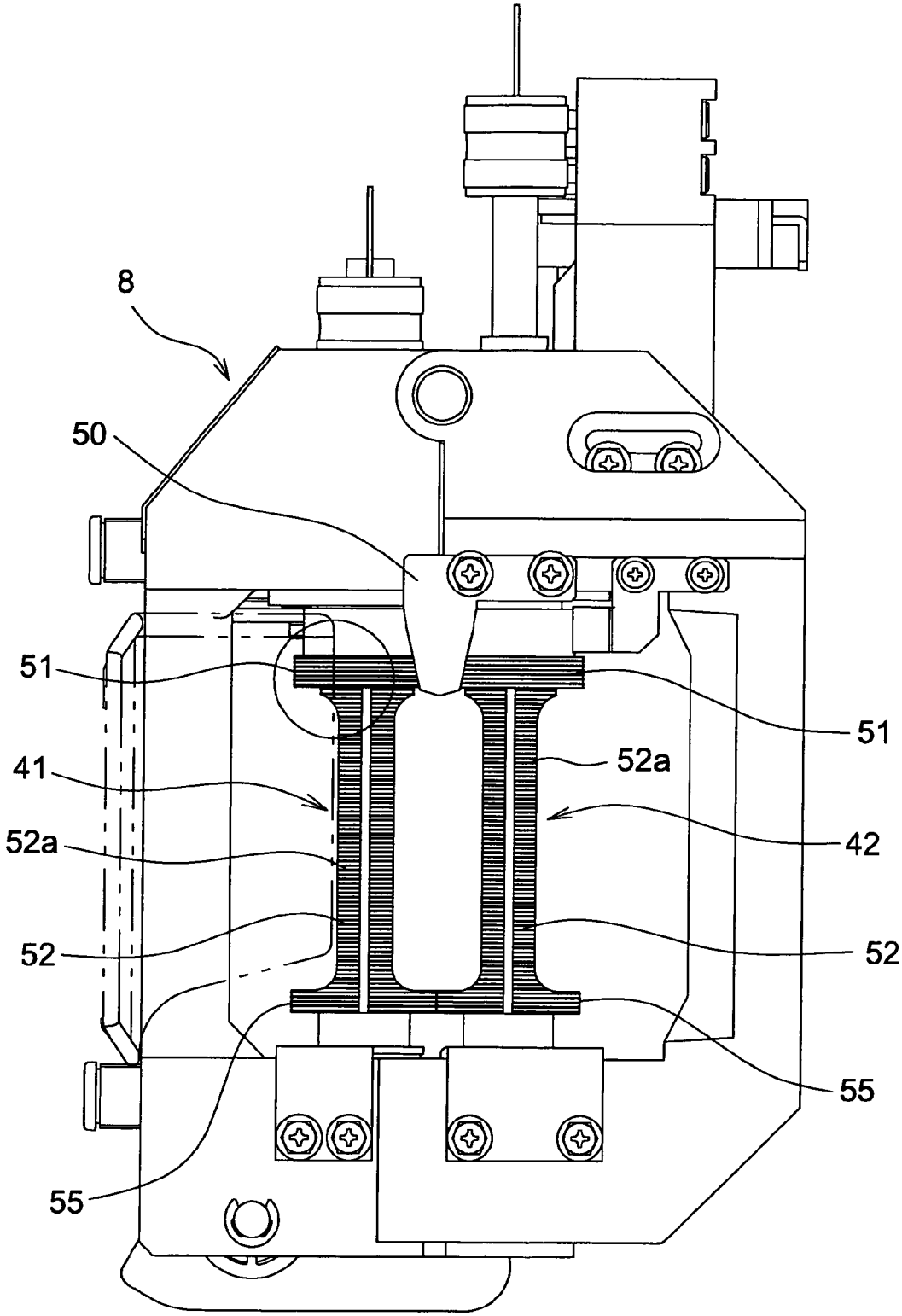
FIG. 9 is a partial front view of the packing unit.
Figure 1O:
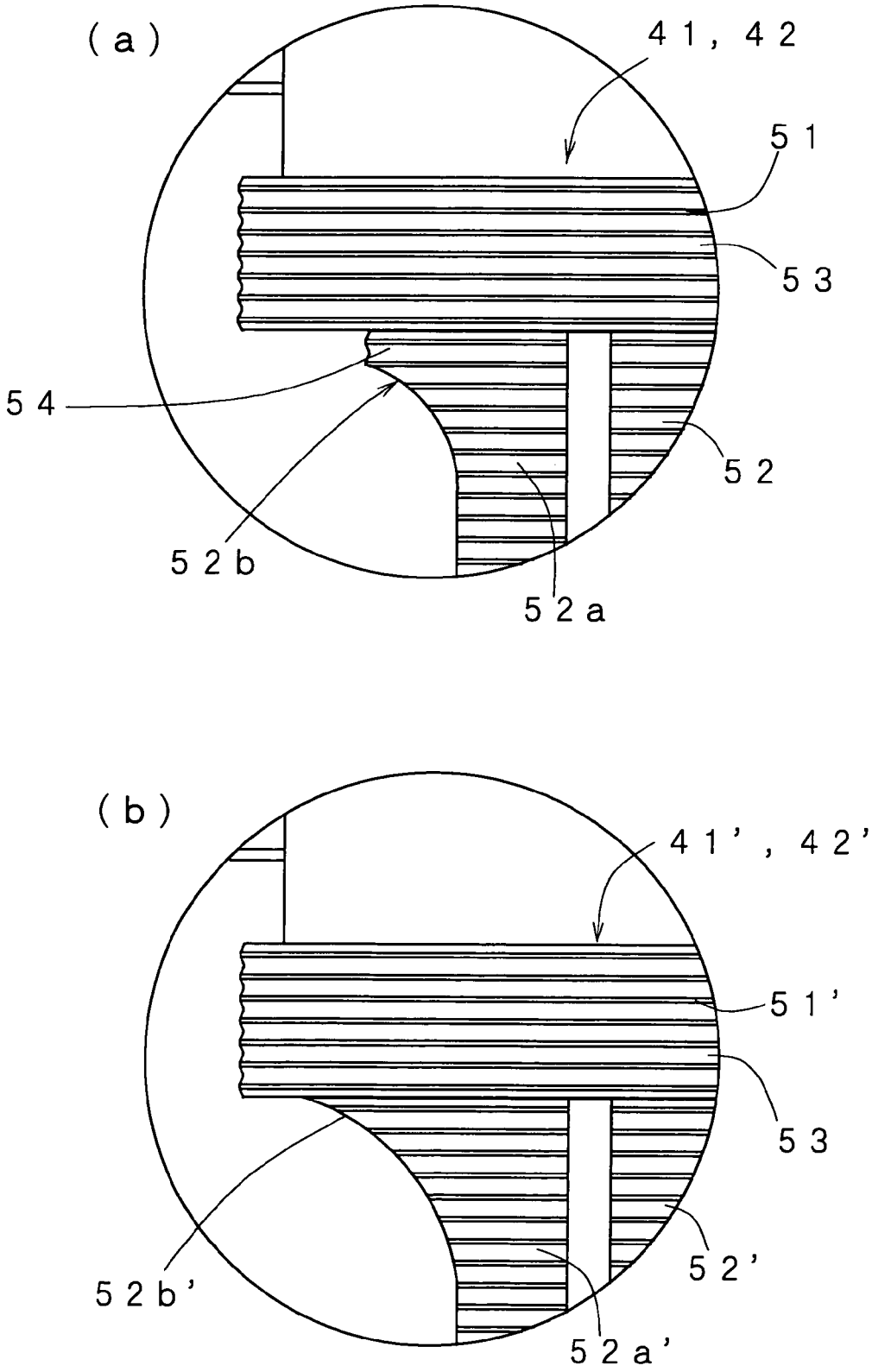

Referring further to FIG. 9, on the upstream side of the feed rollers 39 with respect to the feed direction of the packing sheet 7, there are disposed a pair of heater rollers 41, 42 and a restriction plate 50 for delivering the packing sheet 7 to the heater rollers 41, 42 in a V-shaped opened state. Each of the heater rollers 41, 42 is provided with a feed heat-seal portion 51 of circular plate and a vertical heat-seal portion 52 of thin rectangular plate on the lower end of which a roller portion 55 having the same diameter as that of the feed heat-seal portion 51 is integrally formed. The feed heat-seal portions 51, 51 are driven rotatably via gears 40*a*, 40*b* and so on by the motor 37 described above. In this embodiment, as the motor 37, a stepping motor is used so that a change of pulse of the applied voltage allows the conveying quantity to be adjusted. Between the heat-seal portions 51, 51 of the both heater rollers 41, 42, both side edges of the packing sheet 7 are sealed. The vertical heat-seal portions 52 are rotatably driven by means of a rotation drive mechanism separately from the feed heat-seal portions 51, 51 (but, the rotation axes of the feed heat-seal portion 51 and the vertical heat-seal portion 52 coincide with each other). The vertical heat-seal portions 52 are provided with a pair of heat-seal surfaces 52*a* opposite to each other. Since the vertical heat-seal portions 52 of both heater rollers 41, 42 are driven separately from the feed heat-seal portions 51, 51, the seal distance along the conveying direction of the packing sheet 7 formed by the heat-seal surfaces 52*a* can be freely set.

Referring FIG. 10(*a*), construction in the vicinity of the upper end of the vertical heat-seal portion 52 will be explained. On the feed heat-seal portion 51 and the vertical heat-seal portion 52, small grooves 53 extending in a feed direction of the packing sheet 7 are formed at relatively narrow distances. At the heat seal surface 52*a* in the vicinity of the upper end of the vertical heat-seal portion 52 is formed a diameter enlarging portion 52*b* which extends in an arc-like shape outwardly toward the feed heat-seal portion 51. Further, between the diameter enlarging portion 52*b* and the end surface of the feed heat-seal portion 51 is formed a heat-seal introducing portion 54 of circular plate having a thin thickness. Referring to FIG. 10(*b*), in this kind of conventional heat rollers 41', 42', the diameter enlarging portion 52*b*' of the heat seal surface 52*a*' of the vertical heat-seal portion 52' has come into direct contact with the end surface of the feed heat-seal portion 51'. In such construction of FIG. 10(*b*), a tension force acts on the packing sheet 7 in the vicinity of the contact portion of the feed heat-seal portion 51' and the vertical heat-seal portion 52' becomes non-uniform, which causes the packing sheet 7 to shift with respect to the feed heat-seal portion 51' and the vertical heat-seal portion 52', resulting in wrinkle in the packing sheet 7 after completion of the seal. On the other hand, in the present invention, as the heat-seal introducing portion 54 of circular plate is formed between the diameter enlarging portion 52*b* and the end surface of the feed heat-seal portion 51 is formed as shown in FIG. 10(*a*), a tension force acts on the packing sheet 7 in the vicinity of the contact portion of the feed heat-seal portion 51 and the vertical heat-seal portion 52 becomes uniform, which allows the packing sheet to be smoothly introduced between the heater rollers 41, 42, thereby preventing the generation of the aforementioned wrinkle.

Operation of the aforementioned medicine packing apparatus will be described.

Figure 8:
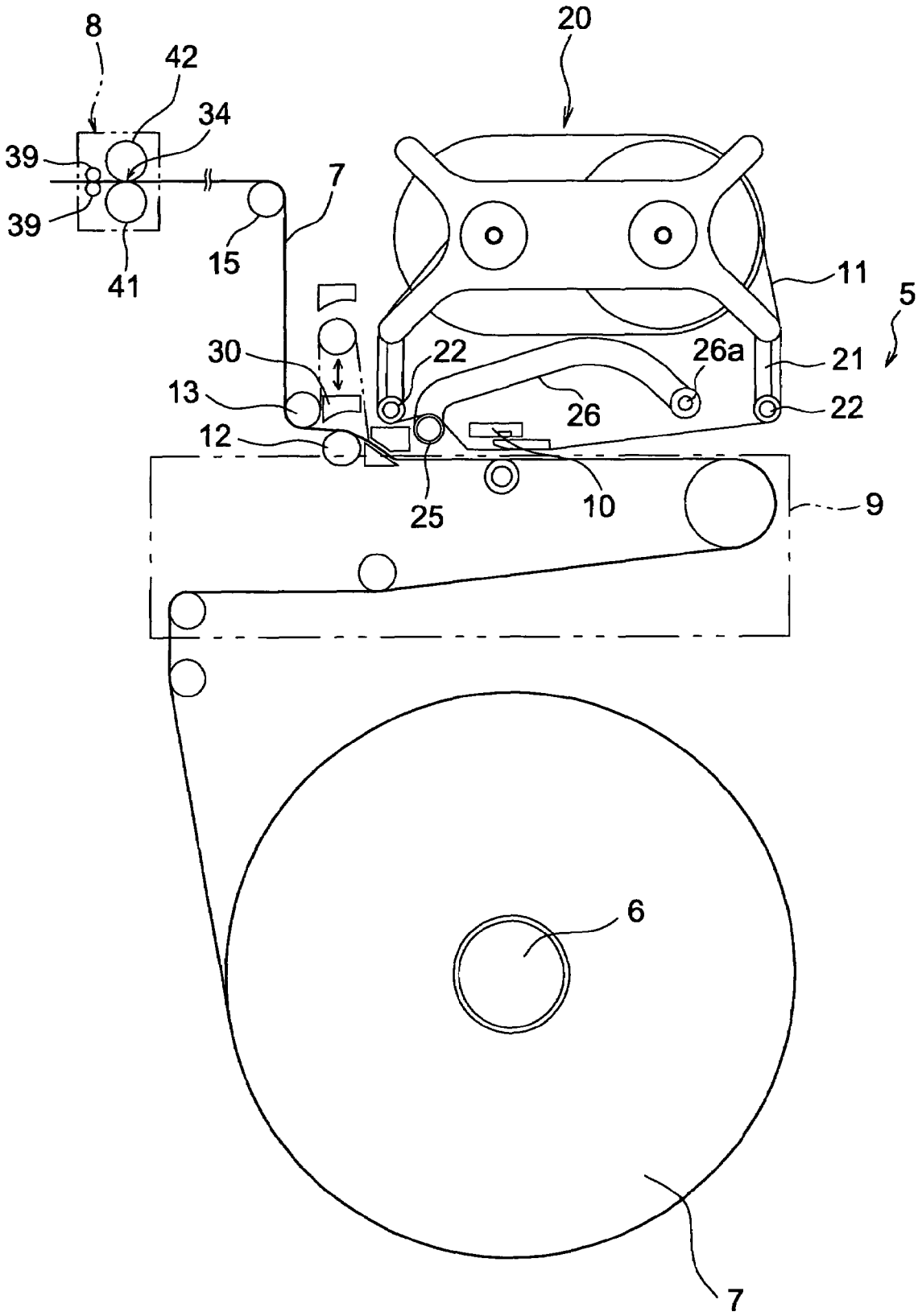
FIG. 8 is a schematic illustrative explanatory view showing a conveying path of the packing sheet.

Before starting the packing process, slack of the packing sheet 7 may exist between the heater rollers 41, 42 of the packing unit 8 and the thermal transfer portion 10 of the print unit 5. This slack is eliminated by the urged (biased) tension roller 12 moving upward as shown in two-dots chain line in FIG. 8. In this case, the distance between the seal portion 34 and the thermal transfer portion 19 varies in accordance with the quantity of eliminated slack.

So, the feed roller 39 is driven to rotate first, allowing the packing sheet to be conveyed. Thus, tension acting on the packing sheet 7 is increased, thereby causing the tension roller 12 to descend against the urging force of the spring 32. When the sensor 33 (see FIG. 6) detects that the tension roller 12 has descended to the descending position, the thermal transfer portion is heated to start printing of the packing sheet 7. Thus, the packing sheet 7 can be printed as the tension acting on the packing sheet 7 remains constant, thereby allowing the dimension between the seal portion 34 and the thermal transfer portion 10 to be held at a predetermined value.

Subsequently, when the packing sheet 7 with predetermined print is conveyed to the packing unit 8, the heater rollers 41, 42 are rotated so that the packing sheet 7, which is folded into two, is sealed to make bags. Then, medicine is fed from the tablet feed portion 2 or the powder feed portion 3 in accordance with a prescription data and introduced into the packing sheet 7 via the packing hopper 35. After that, rotation of the heater rollers 41, 42 is continued so that the remaining part of the packing sheet 7 is sealed to complete the packing of medicine to be packed into one package.

As described above, according to the medicine packing apparatus, when starting the packing process, printing is surely commenced after descending the tension roller 12 and detecting the descended position thereof by means of the sensor 33. Therefore, tension force acting on the packing sheet 7 becomes constant, allowing the dimension between the seal portion 34 and the thermal transfer portion 10 to be accurately held to a constant value, enabling the data to be correctly printed at the desired position.

In the aforementioned embodiments, although the tension roller 12 is constituted so as to descend and ascend and the position thereof is detected so that the position thereof can be detected so that the dimension between the print position and the seal position of the packing sheet 7 can be held to a predetermined value, it is also allowable that, for example, tension detecting means for detecting tension acting on the packing sheet 7 is provided and printing by the thermal transfer portion 10 is commenced after the tension detected by the tension detection means becomes a predetermined value. As the tension detecting means, an arm or the like that comes into contact with the packing sheet 7 and changes its rotation angle in accordance with the difference in the tension of the packing sheet 7 would be given but the construction thereof would not be limited.

The invention claimed is:

1. A medicine packing apparatus in which a packing sheet is printed with predetermined information by printing means, medicine is fed into the packing sheet by medicine feed means, and the packing sheet is sealed by seal means so as to pack the medicine in single packages, wherein:

the seal means is provided with a conveyance portion for conveying the packing sheet;

in the middle of a conveyance path from the print means to the seal means, there are provided moving means which comes into contact with the packing sheet and descends and ascends along a linear path so that the tension of the packing sheet is held at a constant value, and position detecting means which detects a descending position of the moving means;

wherein the moving means comprises a roller, which is rotatable and movable, and urging means for urging the packing sheet with a constant force to eliminate slack in the packing sheet, and wherein the printing means is operable in response to a detection of the descending position by the position detecting means during conveyance of the packing sheet by the conveyance portion.

2. The medicine packing apparatus as claimed in claim 1, wherein the roller is a tension roller attached on a table which is movable in an upward direction and a downward direction along a guide rail, the tension roller being operable to move the packing sheet in the upward direction; and wherein the urging means is a spring for urging the table in the upward direction.

3. The medicine packing apparatus as claimed in claim 2, wherein the position detecting means is operable to detect a lower position of the table.

4. A medicine packing apparatus comprising:

a sealing unit including a packing sheet conveyor for conveying a packing sheet along a packing sheet conveying path, wherein the sealing unit is operable to seal the packing sheet so as to form medicine packages;

a printing unit, disposed along the conveying path, for printing on the packing sheet, wherein the sealing unit is disposed along the conveying path downstream of the printing unit;

at least one medicine feeder for feeding medicine into the packing sheet;

a tension roller disposed along the conveying path between the printing unit and the sealing unit, wherein the tension roller is movable in an upward direction and a downward direction;

urging means for urging the tension roller in the upward direction to remove slack in the packing sheet; and a position detector for detecting a predetermined position of the tension roller, the predetermined position corresponding to a desired tension in the packing sheet, wherein a printing operation can be initiated when the position detector detects the predetermined position of the tension roller after the packing sheet conveyor begins conveying the packing sheet.

5. The medicine packing apparatus as claimed in claim 4, wherein the tension roller is connected to a table which is movably supported on vertical guide rails.

6. The medicine packing apparatus as claimed in claim 5, wherein the urging means comprises a spring, and the position detector comprises a sensor for sensing the position of the table.

7. The medicine packing apparatus as claimed in claim 5, wherein operation of the packing sheet conveyor creates tension in the packing sheet which in turn causes the tension roller and table to move in the downward direction to the predetermined position.

* * * * *